US006578621B2

(12) United States Patent
Takizawa et al.

(10) Patent No.: US 6,578,621 B2
(45) Date of Patent: Jun. 17, 2003

(54) INJECTION DEVICE FOR LOW MELTING POINT METALLIC MATERIAL

(75) Inventors: Kiyoto Takizawa, Nagano-ken (JP); Toshiyasu Koda, Nagano-ken (JP); Yuji Hayashi, Nagano-ken (JP); Mamoru Miyagawa, Nagano-ken (JP)

(73) Assignee: Nissei Plastic Industrial Co., Ltd., Nagano-Ken (JP)

( * ) Notice: Subject to any disclaimer, the term of this patent is extended or adjusted under 35 U.S.C. 154(b) by 0 days.

(21) Appl. No.: 10/094,834

(22) Filed: Mar. 7, 2002

(65) Prior Publication Data

US 2002/0124988 A1 Sep. 12, 2002

(30) Foreign Application Priority Data

Mar. 12, 2001 (JP) ..... 2001-068584

(51) Int. Cl.[7] ..... B22D 17/08; B22D 17/30
(52) U.S. Cl. ..... 164/312; 164/113; 164/900
(58) Field of Search ..... 164/312, 316, 164/113, 900

(56) References Cited

U.S. PATENT DOCUMENTS 6,405,784 B2 * 6/2002 Takizawa et al. ..... 164/113

6,516,019 B2 * 2/2003 Takizawa et al. ..... 373/85

* cited by examiner

*Primary Examiner*—Kuang Y. Lin
(74) *Attorney, Agent, or Firm*—Weingarten, Schurgin, Gagnebin & Lebovici LLP

(57) ABSTRACT

The purpose of this invention is to prevent sludge from flowing into a measuring chamber by partitioning the inside of a melt cylinder into a melt stirring part and a molten metal flow passage part, and to stabilize supply of the metallic material and measurement of the molten metal. A nozzle member 14 of which the inside of the rear part is formed into a measuring chamber 13 is attached to the tip of a melt cylinder 11. The end face of the opening periphery of the measuring chamber 13 of the nozzle member 14 faced to the inside of the melt cylinder is projectingly formed into a ring-shaped bearing 14*b*. A hollow stirring shaft 16 provided with stirring blades 15 on the outer periphery is supported by the bearing 14*b* and a bearing member 21 in the rear end of the melt cylinder so as to be freely rotatable with a suction port 25 bored in the side wall of the tip part. An injection rod is put into the stirring shaft and a plunger 17 with a ring valve on the tip is fitted into the measuring chamber 13 so as to be freely movable forwards and backwards. The inside of the melt cylinder is partitioned into a melt stirring part A and a molten metal reservoir B by the stirring shaft 16. The meting cylinder 11 is installed slantwise on the machine base with the nozzle member side downward to use the tip part as a sludge receiver 27.

6 Claims, 3 Drawing Sheets

INJECTION DEVICE FOR LOW MELTING POINT METALLIC MATERIAL

BACKGROUND OF THE INVENTION

1. Field of the Invention

The present invention relates to an injection device for a low melting point metallic material capable of molding a metallic product by directly injection-filling a die with a molten low melting point non-ferrous metal.

2. Detailed Description of the Prior Art

A desired metallic product has been molded by melting a low melting point non-ferrous metal (for example, lead, zinc, tin, aluminum, magnesium or its alloy, etc.) in a heating cylinder with a plunger or a screw installed inside and measuring the molten metal as in the case of plastics, thereafter, injection-filling the die with the metal directly or via a hot runner from the nozzle of the heating cylinder tip by forwarding movement of the plunger or the screw, and cooling it, thus forming desired metal products.

In injection-molding of such metallic materials, unlike plastic materials, a completely molten liquid phase metallic material has little viscosity and hardly causes fluid resistance. Therefore, a measuring means adopted for a conventional in-line screw injection device causes a back-flow of the measuring material due to the injection load pressure by the forwarding movement of the injection screw and decreases the quantity, and this makes the measurement very unstable and makes it difficult to form metallic molded goods with favorable molding accuracy.

As a solution of this problem, the metallic material is not completely molten but the injection-molding is carried out in a semi-molten state by limiting the melting temperature at the solidus curve temperature or higher and at the liquidus curve temperature or lower. A texture of a molten metal in this temperature range is in a semi-molten state (thixotropic state), and this causes fluid resistance to some extent, and leakage of the measurement material due to back-flow caused by the injection load pressure is decreased in compared with that in the liquid phase. Therefore, the measurement is stabilized by excessively measuring a decreased volume by the leakage. In order to satisfy this, highly accurate measurement and injection control are required.

Therefore, the applicants of this invention have ever developed a molding machine capable of injection-molding metallic goods which are favorably molded, even if the molten metallic material is in the liquid phase state or in the semi-molten state, by carrying out molding with that injection device mounted on a machine base slantwise thereto with the nozzle member side downward, which is comprised of a melt cylinder having a heating means around it, a nozzle member of which the rear inside is formed into a measuring chamber and is attached at the tip of the melt cylinder so as to be freely attachable and detachable, a hollow stirring shaft with stirring blades on the outer peripheral wall in the melt cylinder, and an injection rod which is inserted into the stirring shaft and of which the plunger is inserted into the measuring chamber and which is movably fitted freely forwards and backwards.

In the injection device adopted for this injection molding machine, the measuring chamber is in the nozzle member at the tip and bottom of the melt cylinder mounted slantingly, therefore, when sludge (metallic oxide) produced on the surface of a molten metal (hereafter called a molten metal) is taken into the molten metal in a form of minute particles by being stirred in the melt cylinder, it is prone to precipitate in the periphery of the opening of the measuring chamber at the bottom, and this is absorbed into the measuring chamber together with the molten metal by the backward movement of the plunger.

Even if the minute particles in this sludge pass through the plunger flow passage formed by a gap formed for preventing the material from flowing back and are mixed into a product, they do not have an influence on the appearance and strength of it, however, large particles jams the flow passage and cause failures of measurement and injection-filling, or causes instability of measurement. Therefore, it is necessary to prevent the sludge from exerting the evil influence on forming by some means or other.

This invention has been devised considering the circumstances described above, and the purpose thereof is to provide a new injection device for a low melting point metallic material capable of preventing the sludge from flowing into the measuring chamber, and also stably performing supply of a metallic material and measurement of a molten metal by dividing the inside of the melt cylinder into a melt stirring part and a molten metal flow passage part.

SUMMARY OF THE INVENTION

This invention for the above purpose relates to an injection device for a low melting point metallic material, wherein the device is comprised of a melt cylinder having a heating means around it, a nozzle member of which the rear part is formed into a measuring chamber and which is mounted to be freely attachable and detachable at the tip of the melt cylinder, a hollow stirring shaft having stirring blades on the outer periphery of the shaft in the melt cylinder, and an injection rod which is inserted into the stirring shaft so as to be freely movable forwards and backwards and of which the plunger at the tip is inserted into the measuring chamber, and wherein the device is slantingly installed on a machine base with the nozzle member side downwards, and wherein the peripheral end face of the opening of the measuring chamber faced to the inside of the melt cylinder of the above nozzle is projectingly formed into an annular bearing; the above-mentioned stirring shaft is supported to be freely rotatable by the bearing member in the nozzle member and the rear end face of the melt cylinder with suction ports bored in the wall of the shaft tip part; the inside of the melt cylinder is partitioned by the stirring shaft into a melt stirring part provided with a material supply port and a molten metal reservoir communicating with the above-mentioned measuring chamber; and the material supply port is arranged on the upper side part of the melt cylinder which is at a temperature in the range not exceeding the melting point of the low melting point metallic material.

Moreover, the above-mentioned stirring shaft is supported by the above-mentioned nozzle member with the inner diameter of the tip part enlarged; the shaft has lots of minute holes on the peripheral wall between the bearing tip end and the above-mentioned suction ports; the inside of the melt cylinder tip end where the holes are positioned functions as a sludge reservoir by the slant installation; and the shaft has an overflow outflow port bored in the side wall above the molten metal surface.

Further, the plunger at the tip of the above-mentioned injection rod is mounted with a ring valve having seal rings buried in the outer peripheral surface so that the valve is freely movable forwards and backwards on the outer periphery thereof, and the flow passage formed between the ring valve and the plunger is made to be opened or closed according to contact or separation between the rear end face of the ring valve and the seat ring serving also as a guide of the rear part of the plunger, and thereby the plunger is put into the above-mentioned measuring chamber so as to be freely movable.

DETAILED DESCRIPTION OF THE PREFERRED EMBODIMENT

Figure 1:
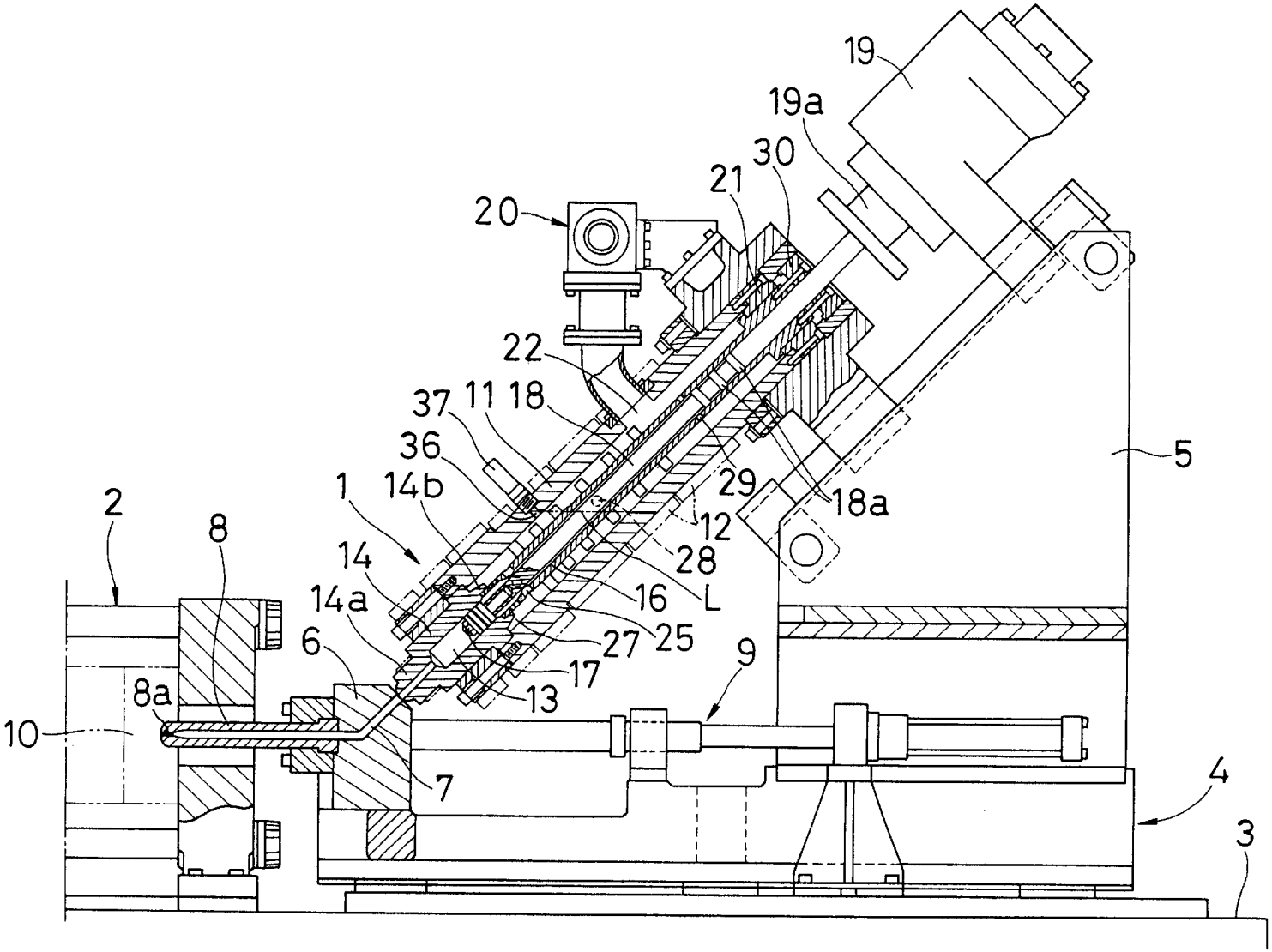
FIG. 1—A drawing of a main part longitudinal section of the injection machine provided with the injection device of a low melting point metallic material relating to this invention.

Referring to the figures, the reference 1 designates an injection device, and the reference 2 designates a clamping mechanism, and both of them are installed on the upper surface of a machine base 3. The reference 4 is a pedestal 4 installed to be movable freely forwards and backwards with respect to the clamping mechanism 2, and a frame 5, of which the upper face is slanted, is installed on the rear part thereof so as to be freely turn, and the above-mentioned injection device 1 is slantwise installed on the frame 5 with the nozzle member side downwards.

The reference 6 designates a nozzle touch block of the front part of the pedestal 4, comprises an injection nozzle 8 connected to an inner hot runner 7 at the front face thereof, and the nozzle of the injection device 1 touches the frame on the rear slant face. The reference 9 is a nozzle touch device arranged over the upper surface of the machine base across the pedestal 4, and this moves the pedestal 4 with the injection device 1 forwards and backwards to the above-mentioned clamping mechanism 2 provided with a metallic mold 10.

The above-mentioned injection device 1 comprises a melt cylinder 11 having a heating means by band heaters 12 around the outer periphery thereof, a nozzle member 14 which is formed into a measuring chamber 13 in the rear part and fitted at the tip of the melt cylinder 11 so as to be freely attachable and detachable, a stirring shaft 16 which is hollow and has many stirring blades 15, 15 on the outer periphery in the melt cylinder 11 at every prescribed interval, and an injection rod 18 movable freely forwards and backwards which is put into the stirring shaft 16 and of which the plunger 17 at the tip is closely inserted into the above-mentioned measuring chamber 13. Moreover the injection device 1 is provided with a hydraulically operated injection cylinder 19 for moving the injection rod 18 forwards and backwards, an electric motor (not illustrated in the figure) for rotating or reciprocally turning the stirring shaft 16, and a material supplying device 20.

The above-mentioned melt cylinder 11 is formed of a cylindrical body of which the front end and the rear end are open, and the front opening is closed by the engagement with the above-mentioned nozzle member 14, and the rear end is also closed by a bearing member 21 fitted into the inside thereof, and is provided with a material supply port 22 in an area at a temperature not exceeding the melting point of the low melting point metallic material in the melt cylinder 11, namely, on the upper side part at a low temperature apart from the molten metal surface, and the above-mentioned material supplying device 20 is mounted on the material supply port 22.

In this low temperature part, the stirring shaft 16 is also at a low temperature, therefore, even if the particle-like metallic material from the material supply port 22 comes into contact with the stirring shaft 16, it is prevented that the particles are surface-melted and adhered to the stirring shaft 16. Since many of them are accumulated and solidified, they are net prevented from falling on the molten metal surface of the metallic material. Thus all the metallic material (flake-like or particle-like) fed from the material supplying device 20 can be made to fall on the molten metal surface, therefore, a supply shortage caused by jamming of the material in the vicinity of the material supply port 22 is prevented from occurring.

The above-mentioned nozzle member 14 is composed by forming the front part of a cylinder, which has a smaller inner diameter than the melt cylinder 11 and is provided with a flange on the rear end periphery, into the nozzle head 14*a*; forming the rear inner part into the above-mentioned measuring chamber 13 of a prescribed length, and forming the peripheral end face of the opening of the measuring chamber 13 into a projecting annular bearing 14*b*.

Figure 2:
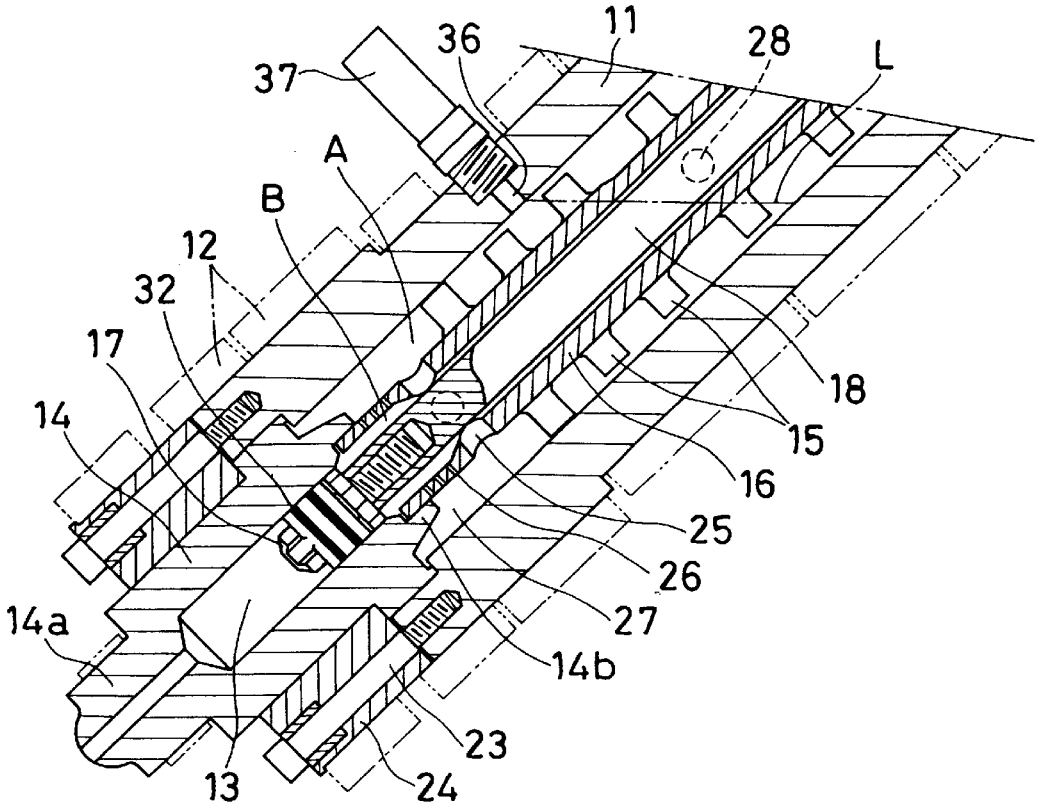
FIG. 2—A longitudinal section of the tip part of the injection device in accordance with this invention.

As shown in FIG. 2, such a nozzle member 14 can be fitted to the tip of the melt cylinder 11 without clearance by engaging the above-mentioned flange with the step part formed in the opening of the melt cylinder 11 and facing the opening of the measuring chamber 13 into the melt cylinder, then fitting a thick stop ring 24 with bolt holes into the nozzle head 14*a* to put it on the flange, and screwing the bolts 23 into the bolt holes in the edge of the opening of the melt cylinder 11. Moreover, by this fitting, the opening of the measuring chamber 13, together with the above-mentioned bearing 14*b* on the periphery, is made to face the inner part of the melt cylinder 11 and positioned to be aligned with the center of the cylinder tip.

The above-mentioned stirring shaft 16 is formed of a pipe body of a diameter permitting to be supported inside of the above-mentioned bearing 14*b* so as to be freely rotatable. The inside diameter of the tip part is partly enlarged and its upper part side wall is provided with the suction ports 25 bored in four directions. The peripheral wall between these suction ports 25 and the enlarged bearing tip is provided with many minute through-holes 26 (refer to FIG. 2), and the inside of the tip of the melt cylinder 11, where the through-holes 26 are positioned, is made to work as a sludge reservoir 27 by the slantwise setting of the tip inside. Moreover, an overflow outflow port 28 is bored in the side wall above a molten metal level L, and further an inert gas inlet port 29 is bored in the side wall upper than the former one.

Such a stirring shaft 16 is supported by the above-mentioned bearing member 14*a* at the rear end of the nozzle member and the bearing member 21 in the melt cylinder rear end and is arranged in the center of the melt cylinder 11. Thereby, the inside of the melt cylinder 11 is partitioned into a melt stirring part A provided with the material supply port 22 and a molten metal reservoir B in the stirring shaft 16 communicating with the above-mentioned measuring chamber 13.

Moreover, a pulley 30 for rotation is mounted on the shaft end projecting outside of the bearing member 21 of the stirring shaft 16, and the stirring shaft 16 is rotated or oscillated (reciprocally moved) by an unshown electric motor so as to be able to stir the molten metal.

The above-mentioned injection rod 18 is composed by inserting a rod formed with guides and back-flow preventing rings 18*a* into multiple stages on the rear outer periphery into the above-mentioned stirring shaft 16 so as to be freely movable forwards and backwards with flow passage clearance arranged around it. The above-mentioned plunger 17 is tightened to the tip projecting from the stirring shaft 16 by screwing it in.

Moreover, the rear end projecting outside of the stirring shaft 16 is connected with the piston rod 19*a* of the above-mentioned injection cylinder 19, and the plunger 17 on the tip moves forwards and backwards in the measuring chamber together with the piston rod 19*a*, so that the molten material in the melt cylinder can be measured and injected according to the movement.

Figure 4:
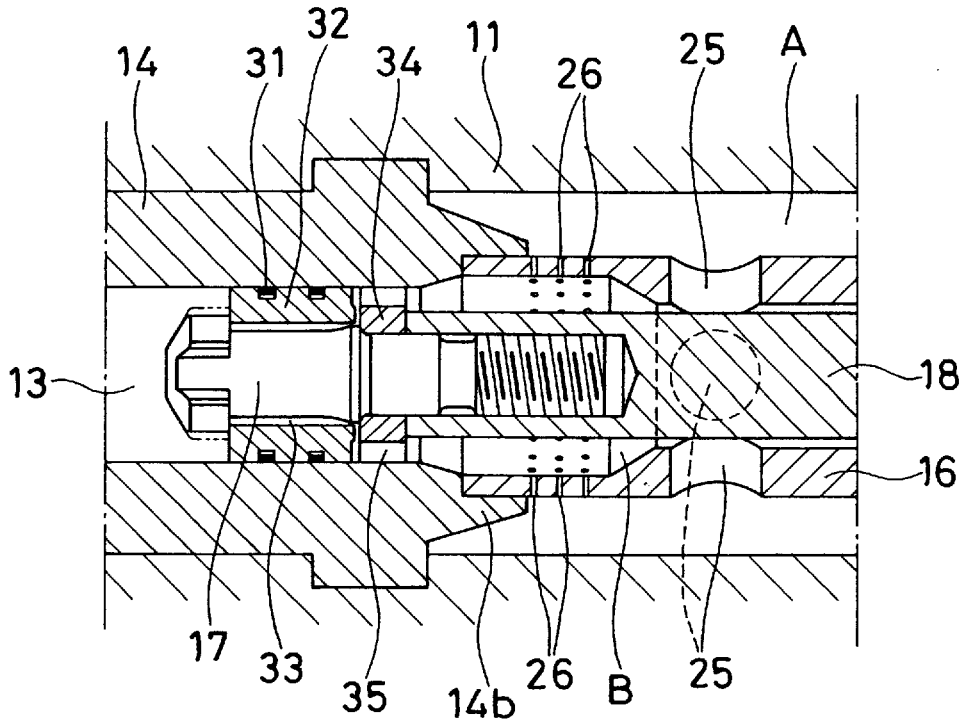
FIG. 4—A longitudinal section of the plunger and its periphery.
Figure 5:
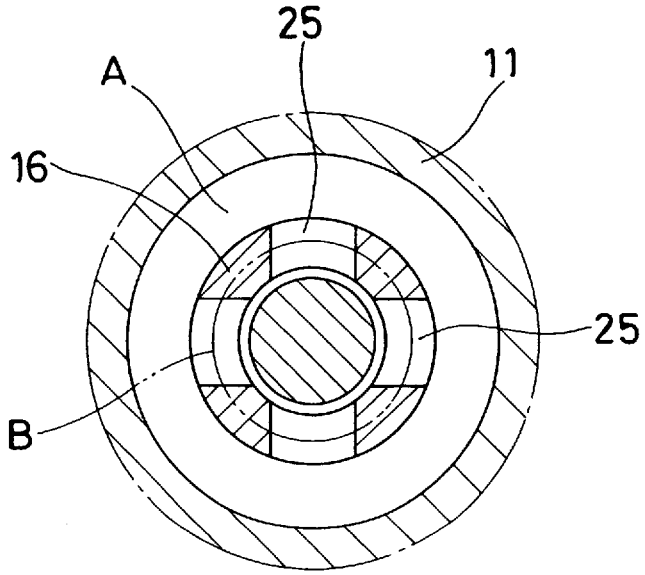
FIG. 5—A longitudinal section of the suction port part.

As shown in FIG. 4, the plunger 17 tightened to the tip of the above-mentioned injection rod 18 by screwing is provided with a ring valve 32 to be freely movable forwards and backwards in which two pieces of seal rings 31 consisting of heat resistant piston rings of an expansion-free diameter are buried in the outer peripheral surface, and is fitted into the above-mentioned measuring chamber 13 so as to be freely slidable therein, by making it possible to open/close the flow passage 33 formed between the ring valve 32 and the plunger 17 by contact/separation between the rear end face of the ring valve 32 and the seat ring 34.

The above-mentioned seat ring 34 is formed to partly have almost the same outside diameter as the inside diameter of the measuring chamber 13, leaving the flow passage part 35 in the plane except the valve contact face formed in the vertical plane, and this arrangement makes it possible to hold the plunger 17 at the center of the measuring chamber 13 together with the ring valve 32.

The reference 36 is an inert gas supply port arranged on the side wall of the melt cylinder at the molten metal level L, and a member 37 provided with three functions of inert gas supply, level detection of the molten metal L, and bubbling is mounted on this part.

In the injection device 1 of the above-mentioned structure, it is possible to heat the inside up to the melting point temperature of a low melting point metal or higher (for example, 620°–680° C. for magnesium) by heating the melt cylinder 11 with band heaters 12. In this heated state, the above-mentioned stirring shaft 16 is brought into stirring state by being rotated or oscillated at a given speed, and a metallic material is supplied from the material supply port 22 in the atmosphere in which the melt cylinder is filled with inert gas, then, since the melt cylinder 11 is slanted downwards, the metallic material immediately falls into the molten metal stored in the tip part of the melt cylinder 11. Then, it is melted by the heat of the molten metal and is mixed into the molten metal by the stirring blades 15. Thus, the metallic material is melted in a very short time.

Moreover, in the tip of the melt cylinder 11, the molten metal in the bottom of the melt stirring part A is made to flow into the stirring shaft from the above-mentioned suction port 25, and is stored in the molten metal reservoir B in the tip part of the stirring shaft 16 widely formed by expanding the diameter in a state isolated from the molten metal stirring part A.

Therefore, the sludge taken in from the molten metal surface by stirring in the molten metal stirring part A is prevented from mixing into the molten metal after stored in the molten metal reservoir B. Moreover the sludge mixed in the molten metal stirring part A is naturally exhausted from lots of minute through-holes 26 into a sludge receiver 27 formed under the bearing 14*b* of the nozzle member rear end, therefore, the sludge is extremely decreased in the mixing amount.

The molten metal stored in this molten metal reservoir B is made to flow into the measuring chamber 13 as if it were sucked therein because the above-mentioned ring valve 32 is opened by the negative pressure in the measuring chamber generated at the time of forcibly moving the plunger 17 backwards together with the above-mentioned injection rod 18. At the same time, the molten metal in the molten metal stirring part A is sucked into the molten metal reservoir B from the suction port 25. The above-mentioned negative pressure is generated for the reason that the nozzle port of the injection nozzle 8 is closely plugged with the cold plug 8*a* formed of residual resin.

And, when the plunger 17 is pushed out by the injection rod 18, a certain amount of molten metal stored in the measuring chamber 13, namely, the material to be measured, is pressed by the plunger 17, and thereby the ring valve 32 is closed to prevent the molten metal from flowing back into the molten metal reservoir B, and thereafter, the cold plug 8*a* is pushed out of the nozzle port by being further pressurized by the plunger 17 and is filled in the above-mentioned metallic mold 10 by injection.

Since this forward movement of the plunger expands the molten metal reservoir B in the rear part thereof, the molten metal in the molten metal stirring part A is absorbed into the molten metal reservoir B from the suction port 25 associated with the movement. Thus, since the molten metal on the molten metal stirring part A is supplied to the molten metal reservoir B by the reciprocal movement of the plunger 17, the molten metal can be supplied to the measuring chamber 13 without shortage even if the inside of the melt cylinder 11 is partitioned into the molten metal stirring part A and the molten metal reservoir B by the stirring shaft 16 so that the sludge is prevented from being mixed into the molten metal to be measured.

Moreover, the sludge taken into the molten metal in the molten metal stirring part A precipitates in the sludge receiver 27 formed in the tip part at the lowest position of the melt cylinder 11, however, the opening of the measuring chamber 13 is shielded from the sludge receiver 27 by the bearing 14*b;* stirring is not carried out in that part; and the suction port 25 is arranged in the upper part, therefore, the sludge cannot directly flow into the measuring chamber 13 together with the molten metal even if the opening of the measuring chamber 13 is inevitably at the same position as the sludge receiver 27.

Figure 3:
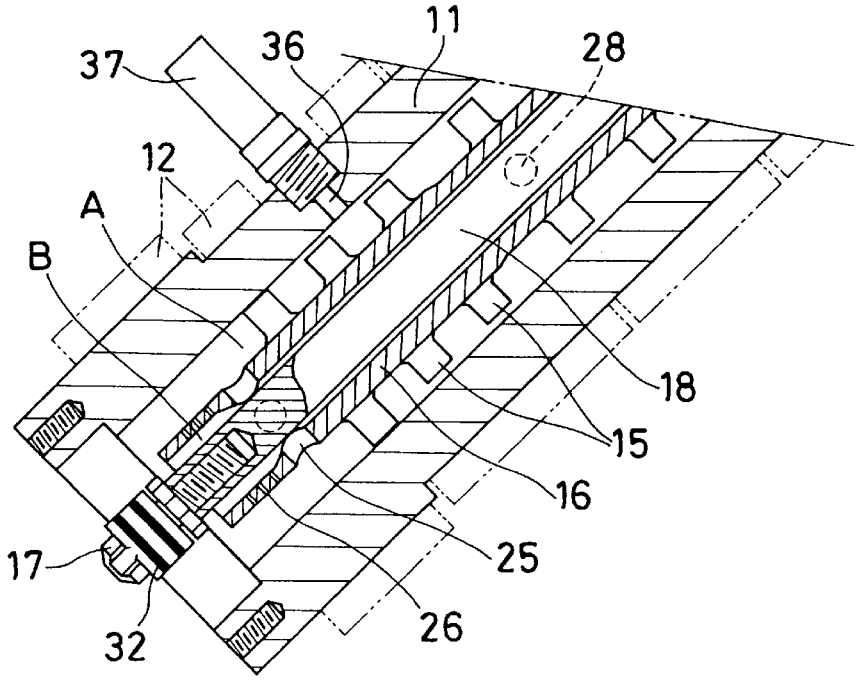
FIG. 3—A longitudinal section illustrating a state in which the nozzle member is removed from the above.

Moreover, since the tip opening of the melt cylinder 11 is fully made open by removing the nozzle member 14 as shown in FIG. 3, the sludge precipitating in the sludge receiver 27 can easily be removed.

Thus, the problem of sludge mixing is solved, and further, injection molding of a product of a non-ferrous metal can be realized with a high molding accuracy.

What is claimed is

1. An injection device for a low melting point metallic material comprising a melt cylinder provided with a heating means on the outer periphery thereof, a nozzle member of which the inside of the rear part is formed into a measuring chamber and which is attached at the tip of the melt cylinder so as to be freely attachable and detachable, a hollow stirring shaft provided with stirring blades on the outer periphery thereof in the melt cylinder, and an injection rod which is put into the stirring shaft and of which a plunger on the tip is closely inserted into the measuring chamber so as to be freely movable forwards and backwards, and being mounted on a machine base slantwise thereto with the nozzle member side downward, characterized in that the end face of the opening periphery of the measuring chamber facing the inside of the melt cylinder of said nozzle member is projectingly formed into an annular bearing;

said stirring shaft is supported by the nozzle member and a bearing member in the rear end part of the melt cylinder with a suction port bored in the outer side wall of the tip part thereof; and the inside of the melt cylinder is partitioned into a melt stirring part provided with a material supply port and a molten metal reservoir communicating with said measuring chamber by the stirring shaft.

2. The injection device for a low melting point metallic material as claimed in claim 1, characterized in that said melt cylinder is provided with said material supply port on the upper side in the area where the temperature does not exceed the melting point of the low melting point metallic material.

3. The injection device for a low melting point metallic material as claimed in claim 1, characterized in that said stirring shaft is supported by said nozzle member with the inside diameter of the tip part enlarged;

the shaft is provided with lots of minute through-holes on the peripheral wall between the bearing tip and said suction port; and the inside of the tip part of the melt cylinder where the through-holes are positioned serves as a sludge receiver by the slanting installation thereof.

4. The injection device for a low melting point metallic material as claimed in claim 1, characterized in that said stirring shaft is provided with an overflow outflow port bored on the side wall upper than the molten metal surface level.

5. The injection device for a low melting point metallic material as claimed in claim 1, characterized in that the plunger on the tip of said injection rod is provided with a ring valve with seal rings buried in the outside wall so that the valve is freely movable forwards and backwards to the outer periphery, and is closely inserted into said measuring chamber so as to be freely movable by making it possible to open/close the flow passage formed between the ring valve and the plunger by contact/separation between the rear end face of the ring valve and a seat ring serving also as a guide at the rear part of the plunger.

6. The injection device for a low melting point metallic material as claimed in claim 3, characterized in that said stirring shaft is provided with an overflow outflow port bored on the side wall upper than the molten metal surface level.

* * * * *

UNITED STATES PATENT AND TRADEMARK OFFICE

CERTIFICATE OF CORRECTION

PATENT NO. : 6,578,621 B2
DATED : July 17, 2003
INVENTOR(S) : Kiyoto Takizawa et al.

It is certified that error appears in the above-identified patent and that said Letters Patent is hereby corrected as shown below:

Column 8,
Lines 13 and 14, delete "to the outer periphery".

Signed and Sealed this

Nineteenth Day of October, 2004

JON W. DUDAS
*Director of the United States Patent and Trademark Office*